US007270625B2

(12) United States Patent
Miller

(10) Patent No.: US 7,270,625 B2
(45) Date of Patent: Sep. 18, 2007

(54) ARM MOTION ASSEMBLY FOR EXERCISE DEVICE

(76) Inventor: Larry D. Miller, 4030 Oak Tree Cir., Rochester, MI (US) 48306

( * ) Notice: Subject to any disclaimer, the term of this patent is extended or adjusted under 35 U.S.C. 154(b) by 601 days.

(21) Appl. No.: 10/716,312

(22) Filed: Nov. 18, 2003

(65) Prior Publication Data

US 2005/0107219 A1 May 19, 2005

(51) Int. Cl.
*A63B 69/16* (2006.01)
*A63B 22/04* (2006.01)

(52) U.S. Cl. ..... 482/52; 482/70

(58) Field of Classification Search ..... 482/51, 482/52, 57, 70

See application file for complete search history.

(56) References Cited

U.S. PATENT DOCUMENTS

| | | | | | |
|---|---|---|---|---|---|
| 2,603,486 | A | | 7/1952 | Hughes | 272/79 |
| 4,869,494 | A | | 9/1989 | Lambert, Sr. | 272/73 |
| 4,949,954 | A | | 8/1990 | Hix | 272/73 |
| 5,242,343 | A | | 9/1993 | Miller | 482/57 |
| 5,383,829 | A | | 1/1995 | Miller | 482/57 |
| 5,441,467 | A | * | 8/1995 | Stevens | 482/54 |
| 5,562,574 | A | | 10/1996 | Miller | 482/51 |
| 5,577,985 | A | | 11/1996 | Miller | 482/52 |
| 5,653,662 | A | | 8/1997 | Rodgers, Jr. | 482/52 |
| 5,788,610 | A | | 8/1998 | Eschenbach | 482/52 |
| 5,823,919 | A | | 10/1998 | Eschenbach | 482/62 |
| 5,836,855 | A | | 11/1998 | Eschenbach | 482/57 |
| 5,913,751 | A | | 6/1999 | Eschenbach | 482/57 |
| 5,916,064 | A | | 6/1999 | Eschenbach | 482/51 |
| 5,921,894 | A | * | 7/1999 | Eschenbach | 482/57 |
| 5,947,872 | A | | 9/1999 | Ryan et al. | 482/51 |
| 5,957,814 | A | | 9/1999 | Eschenbach | 482/51 |
| 5,993,359 | A | | 11/1999 | Eschenbach | 482/57 |
| 6,017,294 | A | | 1/2000 | Eschenbach | 482/52 |
| 6,017,295 | A | | 1/2000 | Eschenbach | 482/57 |
| 6,024,676 | A | | 2/2000 | Eschenbach | 482/51 |
| 6,159,132 | A | * | 12/2000 | Chang | 482/57 |
| 6,277,056 | B1 | * | 8/2001 | McBride et al. | 482/57 |
| 6,398,695 | B2 | | 6/2002 | Miller | 482/52 |

* cited by examiner

*Primary Examiner*—Stephen R. Crow
(74) *Attorney, Agent, or Firm*—Gifford, Krass, Sprinkle, Anderson & Citkowski, P.C.

(57) ABSTRACT

An arm motion assembly for an exercise device includes a first link which is pivotally affixed to a frame portion of the exercise device at a first pivot point so as to be capable of reciprocal motion thereabout. The assembly includes a second link which is pivotally affixed to a second frame portion of the exercise device at a second pivot point separated from the first pivot point so that the second link is capable of reciprocal motion about the second pivot point. The assembly includes a connector link which extends between the first link and the second link. The connector link is pivotally joined to the first link at a first junction point and to the second link at a second junction point so that when one of said first links and said second links reciprocates about its respective pivot point the connector link causes the other of said links to pivot about its respective pivot point. The assembly includes a handgrip which is affixed to the connector link or to one of the first and second links.

10 Claims, 6 Drawing Sheets

ARM MOTION ASSEMBLY FOR EXERCISE DEVICE

FIELD OF THE INVENTION

This invention relates generally to exercise devices. More specifically, the invention relates to an assembly which may be incorporated into a variety of exercise devices and which provides a natural arm motion.

BACKGROUND OF THE INVENTION

In order to provide exercise to muscle groups in the upper and lower body, many types of exercise devices, including elliptical devices, treadmills, stair steppers, stationary bicycles, ski simulators and the like, provide for motion of a user's arms during exercise. For example, the elliptical exercise devices shown in U.S. Pat. Nos. 5,242,343; 5,383,829; 5,577,985; 5,562,574 and 6,398,695 include members and linkages which allow a user's arms to move back and forth during exercise. Some other exercise devices which provide for arm motion are shown in U.S. Pat. Nos. 4,949,954; 2,603,486; 4,869,494; 5,653,662; 5,913,751; 5,993,359; 5,836,855; 5,788,610; 6,024,676; 6,017,295; 6,017,294; 5,957,814; 5,947,872; 5,916,064; 5,823,919 and 5,921,894.

While a number of exercise devices, and in particular certain elliptical exercise devices, provide a natural range of motion for a user's lower body muscles which simulates a natural running and stepping action, the present invention recognizes that the arm and shoulder motion provided by heretofore available exercise equipment does not simulate a natural upper body motion. Referring now to FIG. 1, there is shown a schematic depiction of a person participating in a machine-assisted exercise. As shown in FIG. 1, the person 10 is using an exercise device, which in this instance is represented by the block 12. It is to be understood that this block 12 is meant to represent any generic exercise device such as a treadmill, elliptical device, stair stepper, stationary cycle, ski simulator or the like. Arrow A traces the path of motion of a user's arm which is achieved through the use of conventional exercise equipment of the type referred to hereinabove. As will be noted, the user's hand travels along a path of motion, A, which is generally horizontal. This path of motion A causes the user's arm to pivot primarily at the elbow, and may also cause some small degree of pivoting at the shoulder joint. Analysis of this motion demonstrates that it is not equivalent to the arm motion which a person's body undergoes when he or she is participating in unassisted aerobic exercise such as running, jogging or walking at a brisk pace. In such instance, the person's hand traverses a path as shown by arrow B. This preferred path of travel is curved and generally inclined relative to the horizontal. It produces a hand and arm movement in which pivoting of the arm occurs primarily at the shoulder joint. An arm action of this type produces a more productive and beneficial aerobic workout and lessens the chance of muscle fatigue or joint trauma. As a consequence, exercise which incorporates this type of arm motion is generally more comfortable for the user, which assures better compliance with an exercise program.

As will be detailed hereinbelow, the present invention provides an arm motion assembly for an exercise device. The arm motion assembly of the present invention provides a very natural arm motion in which a user's arm pivots about the shoulder joint. The assembly of the present invention may be readily implemented in a variety of configurations and is readily adapted to various exercise devices.

SUMMARY OF THE INVENTION

There is disclosed herein an arm motion assembly for an exercise device. The assembly includes a first link which is pivotally supported by a first frame portion of the exercise device at a first pivot point so that the first link is capable of reciprocal motion about the first pivot point. The assembly includes a second link having a handgrip portion. The second link is pivotally supported by a second frame portion of the exercise device at a second pivot point spaced from the first pivot point. The assembly further includes a connector link which extends between the first link and the second link. The connector link is pivotally joined to the first link at a first junction point and to the second link at a second junction point. In one embodiment, the connector link has a handgrip associated therewith; and, when the first and second links pivot about their respective pivot points, the handgrip travels in a reciprocal path.

In another embodiment, the first link is a swing arm and the second link is an arm link having a handgrip portion associated therewith. When the swing arm of this embodiment reciprocates about the first pivot point, the connector link causes the arm link to pivot about the second pivot point so that the handgrip travels in a reciprocal path of travel.

In certain embodiments, the locations of the junction points and pivot points may be made adjustable relative to other portions of the assembly so as to allow a user to control the degree and orientation of the arm motion achieved thereby.

Also disclosed is a specific embodiment of the present invention which is utilized in conjunction with an elliptical exercise device. This device includes a frame having a first pivot axis defined thereupon, a foot link having a foot receiving portion which is configured to support a user's foot, a coupler for coupling a first end of the foot link to the first pivot axis so that the first end of the foot link is directed to travel in an arcuate path, and a guide which is operable to direct the second end of the foot link in a reciprocal path of travel as the first end travels in the arcuate path. This embodiment further includes a first link which is pivotally supported by the frame at a first pivot point defined on the frame, and a second link pivotally supported by the frame at a second pivot point defined on the frame and spaced apart from the first pivot point. The assembly further includes a connector link which extends between the first and second links. The connector link includes a handgrip portion, and is pivotally joined to the first link at a first junction point and to the second link at a second junction point so that when the first link reciprocates about the first pivot axis the connector link causes the second link to pivot about the second pivot axis so as to cause the handgrip to move in a reciprocal path of travel. In specific embodiments of this exercise device, the guide comprises a ramp. In other embodiments, the guide comprises a portion of the swing arm.

Also disclosed is another embodiment of elliptical exercise device in which the first link is a swing arm and the second link is an arm link and has a handgrip portion associated therewith. In this embodiment, the swing arm reciprocates about the first pivot point and causes the connector link to reciprocate the arm link about the second pivot point, so that the handgrip travels in a reciprocal path.

DETAILED DESCRIPTION OF THE INVENTION

Figure 2:
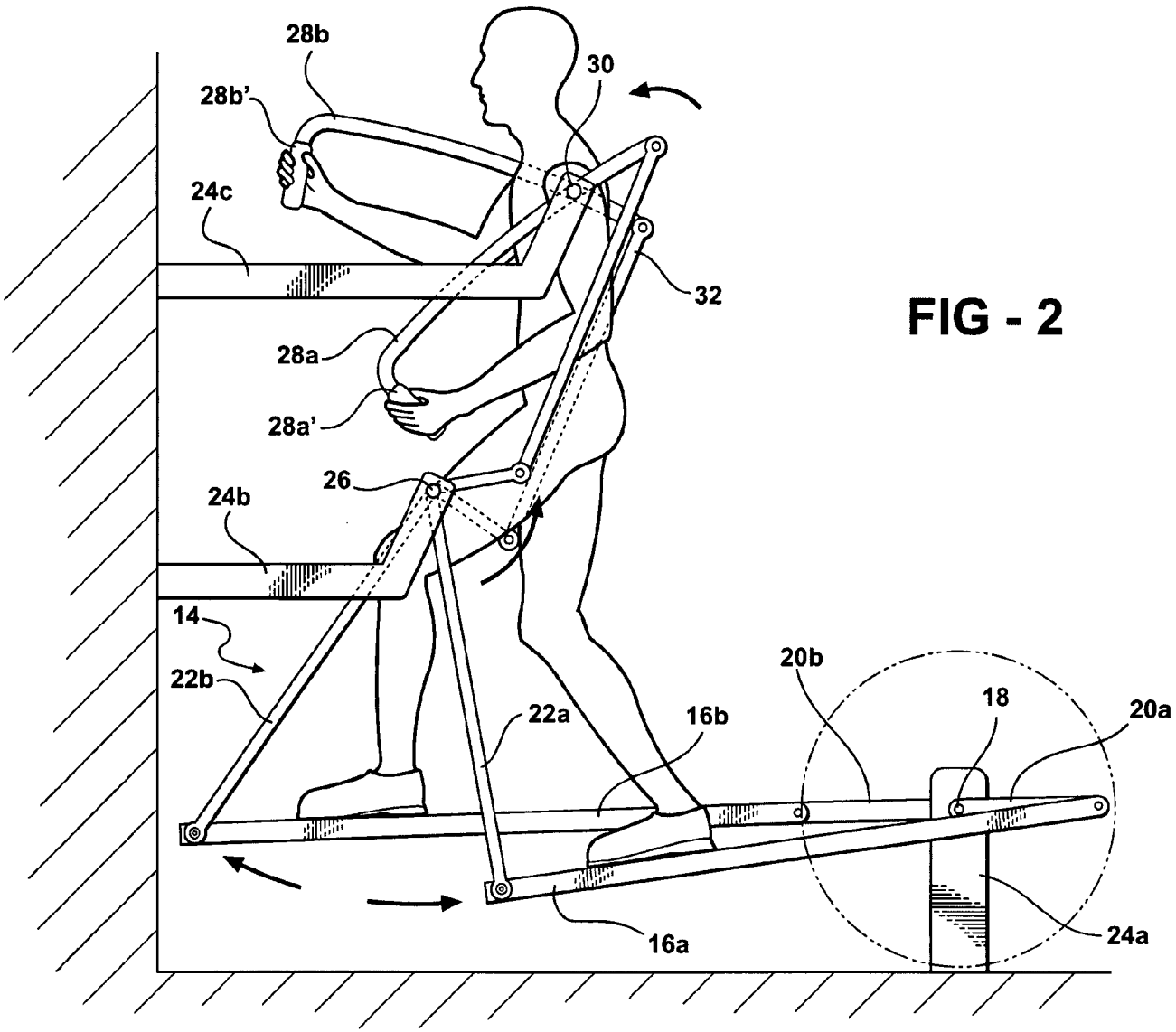
FIG. 2 shows an elliptical exercise device which incorporates one embodiment of arm motion assembly of the present invention.

FIG. 2 shows one embodiment of the arm motion assembly of the present invention as incorporated into an elliptical exercise device. However, it is to be understood that the arm motion assemblies of the present invention are not limited to devices of this type, and may be readily incorporated into other types of exercise equipment which include by way of illustration and not limitation, treadmills, stair steppers, ski simulators, stationary and mobile cycles, and the like.

As is shown in FIG. 2, the elliptical exercise device 14, which incorporates the assembly of the present invention, includes a first and a second foot link 16*a*, 16*b* which are configured to support a user's foot thereupon. The device 14 includes a frame, and for clarity of illustration, the frame is shown in cutaway form with only portions 24*a*, 24*b* and 24*c* depicted. The frame has a first pivot axis 18 defined thereupon, and as is shown in the prior art, for example in U.S. Pat. Nos. 5,242,343 and 5,383,829, the disclosures of which are incorporated herein by reference, a first end of each foot link 16*a*, 16*b* is coupled to this pivot axis 18 by a coupling member 20*a*, 20*b* so that the first end can move in an arcuate path. As illustrated, the coupling members are crank arms and the arcuate path is a circular path which encompasses the pivot axis 18; however, it is to be understood that in other embodiments of elliptical exercise device, the arcuate path may not be a circular path as long as it is a closed path which is at least partially curved. The arcuate path need not encompass the pivot axis. As is known in the art of elliptical exercise devices, a second end of each foot link 16*a*, 16*b* is directed in a reciprocal path of travel by a guide member which may comprise a ramp, a swing arm, or a support surface, such as a floor on which the exercise device is located. As is known in the art, this combination of reciprocal and arcuate motion provides for a generally elliptical path of travel for the user's foot, and this path of travel simulates a natural running and stepping motion wherein when the user's foot travels forward, the heel portion thereof initially rises at a faster rate than the toe portion; and when the user's foot travels rearward, the heel portion thereof initially falls at a faster rate than does the toe portion. In the FIG. 2 embodiment, the second ends of the foot links 16*a*, 16*b* are guided on the reciprocal path by a first set of links which comprise swing arms 22*a*, 22*b* respectively. These swing arms are supported by a portion of the frame 24*b* at a first pivot point 26 defined thereupon.

The assembly further includes a set of second links; and, in the illustrated embodiment, these second links comprise arm links 28*a* and 28*b* which are also pivotally supported upon a second portion of the frame structure 24*c* at a second pivot point 30 defined thereupon. The first 26 and second 30 pivot points are spaced apart on the frame, and may be defined by axles, pins, bearings, journals and other equivalent mechanical structures. As illustrated, each arm link 28*a*, 28*b* includes a handgrip portion 28*a*', 28*b*', and in this embodiment, the handgrip portions 28*a*', 28*b*' are angularly disposed relative to the remainder of their respective arm links. Each arm link 28 is coupled to a respective swing arm 22 by a connector link, and in this drawing only the connector link 32 which joins the first swing arm 22*a* and the first arm link 28*a* is visible.

When the device 14 of FIG. 2 is in operation, the reciprocal motion of a second end of a foot link 16 causes its associated swing arm 22 to reciprocate about a first pivot point 26 causing a corresponding reciprocal motion of a control link 32 which in turn causes the associated arm link 28 to pivot about its pivot point 30. This motion of the arm link provides a natural arm motion for a user who is gripping the handle portion of the arm link.

Figure 3:
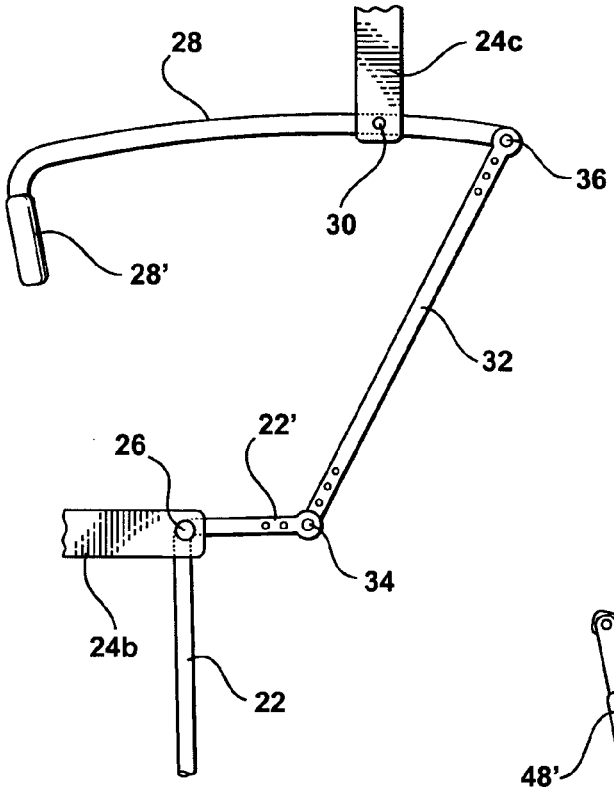
FIG. 3 is an enlarged fragmentary view of a portion of the arm motion assembly of FIG. 2.

Referring now to FIG. 3, there is shown an enlarged view of a portion of the exercise device 14 of FIG. 2 specifically illustrating the arm motion assembly of the present invention. For clarity of illustration only, that portion of the assembly which provides motion to one arm of the user is shown, and it is to be understood that in general most installations will include a corresponding assembly so as to provide motion to both of the user's arms.

As is shown in FIG. 3, a swing arm 22 is pivotally supported by a portion of the exercise device's frame 24*b* at a first pivot point 26. A connector link 32 is pivotally connected to the swing arm 22 at a first junction point 34. This connector link 32 is pivotally joined to an arm link 28 at a second junction point 36. The arm link 28 is supported by another portion of the frame 24*c* at a second pivot point 30 as previously described.

In the FIG. 3 embodiment, the swing arm 22 includes a rocker arm portion 22' which projects therefrom at an angle. The swing arm is supported at the first pivot point 26 at the vertex of this angle. As will be seen, the connector link 32 is joined to the rocker arm portion 22' of the swing arm 22. As is further illustrated, the location of this first junction point 34 may be adjustable, and in that regard, the connector link 32 and/or swing arm 22 may include a number of holes or other connector points predisposed therein. Likewise, the location of the second junction point 36 may be made adjustable, and in this regard, either the connector link or arm link 28 may include predrilled holes or the like therein. By adjustment of the junction points 34, 36, the arm motion may be regulated.

Figure 4:
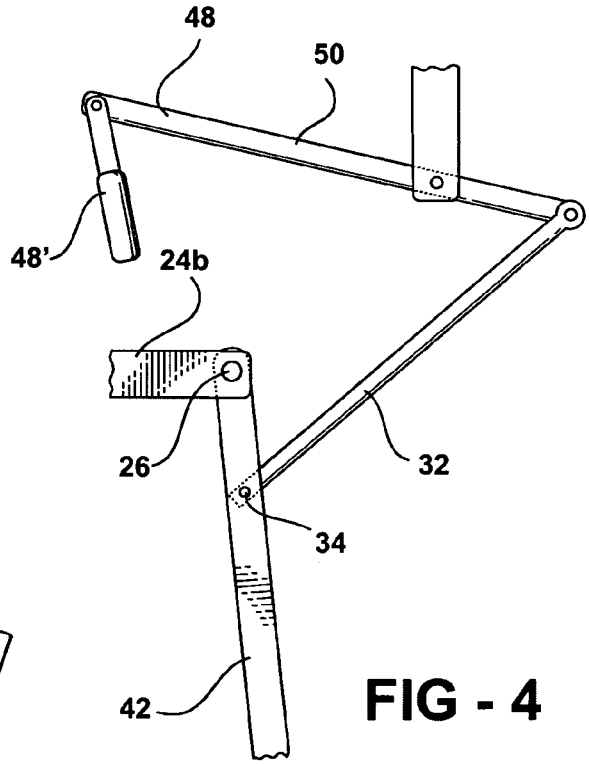
FIG. 4 is a partial fragmentary view of another embodiment of arm motion assembly in accord with the present invention.

Yet other embodiments of the assembly of FIG. 2 may be implemented in accord with the present invention. For example, FIG. 4 shows an arm motion assembly generally similar to that of FIGS. 2 and 3; however, the swing arm 42 does not include any rocker arm portion. Instead, the connector link 32 joins directly to the length of the swing arm 42 at a junction point 34. As is shown, this first junction point 34 is inboard of the first pivot point 26; however, in other embodiments, the swing arm 42 may be connected to the frame portion 24*b* at a first pivot point which is inboard of the free end of the swing arm 42, and the control link may be connected to the swing arm 42 at a junction point 34 which is outboard of the pivot point 26, and in this instance, the free end will project above the pivot point. In the FIG. 4 embodiment, the arm link 48 includes a handle portion 48' which is pivotally connected to the remainder of the arm link 48. This pivotal connection allows for greater freedom of motion of the user's wrist. As is also shown in FIG. 4, the arm link 48 includes a length adjuster section 50. This section may comprise a lockable telescoping portion of the arm link 48, a screw adjustable portion or the like. This length adjustment feature allows the length of the arm link 48 to be increased or decreased to accommodate different user preferences. Similar adjustment features may be incorporated into the other links.

Figure 5:
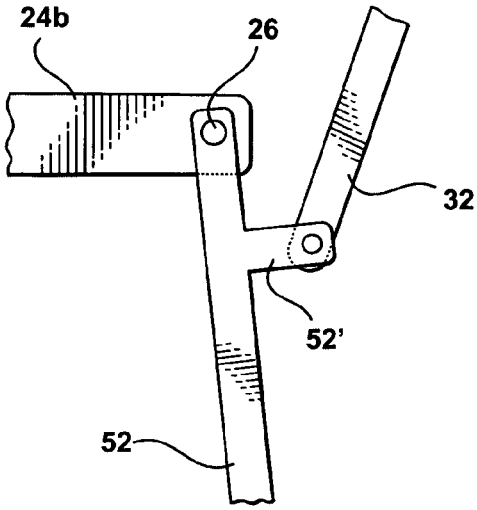
FIG. 5 is a fragmentary view of a portion of yet another arm motion assembly of the present invention.

Referring now to FIG. 5, there is shown a fragmentary view of yet another embodiment of arm motion assembly structured in accord with the principles of the present invention. As is shown in FIG. 5, the arm motion assembly includes a swing arm 52 having a rocker arm portion 52' projecting therefrom. In this regard, the swing arm 52 of FIG. 5 is generally similar to the swing arm 22 of FIG. 3. However, in the FIG. 3 embodiment, the swing arm 22 is joined to the frame 24*b* at a first connection point 26 which is near the vertex of the angle formed by the rocker arm portion 22' and the remainder of the swing arm 22. In the FIG. 5 embodiment, the rocker arm portion 52' of the swing arm 52 projects therefrom at a point between the ends of the remainder of the swing arm 52. In this regard, the first pivot point 26 is spaced from the vertex of the angle formed by the rocker arm portion 52' and remainder of the swing arm 52. It will be understood that yet other embodiments will be readily apparent to one of skill in the art in view of the general teaching given herein.

Figure 6:
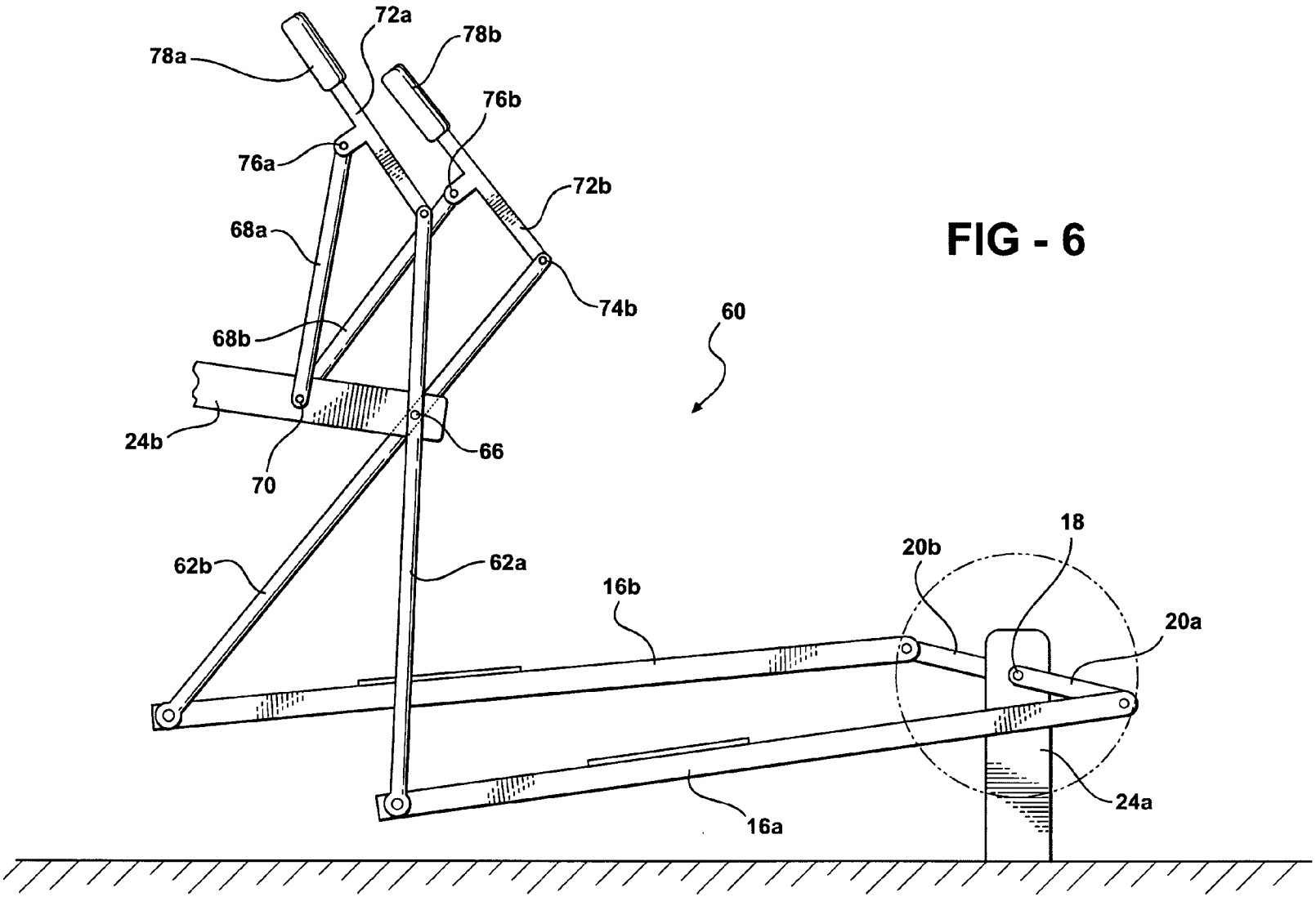
FIG. 6 shows another elliptical exercise device which incorporates an arm motion assembly of the present invention.

Referring now to FIG. 6, there is shown another embodiment of elliptical exercise device 60 which incorporates an arm motion assembly of the present invention therein. This device 60 shares similar elements with the device of FIG. 2, and such elements will be referred to by like reference numerals. The device 60 of FIG. 6 includes a first and a second foot link 16*a*, 16*b* which have a first end thereof coupled to a pivot axis 18 by coupling members 20*a* and 20*b* which comprise crank arms. As in the previous embodiment, these coupling members 20*a*, 20*b* are supported at the pivot point by a portion of the frame 24*a* of the exercise device, and for clarity of illustration, this frame is shown in cutaway view. The second ends of each of the foot links 16*a*, 16*b* are supported by and guided along a reciprocal path of travel by a pair of swing arms 62*a*, 62*b* which comprise the first links of the arm motion assembly of the FIG. 6 embodiment. These swing arms 62*a*, 62*b* are affixed to a frame portion 24*b* of the device 60 at a first pivot point 66, as generally described above. The assembly further includes a second link 68*a*, 68*b* which functions as a control link and is supported by the frame 24*b* at a second pivot point 70.

The assembly of FIG. 6 further includes connector links 72*a*, 72*b* which join the first arm links 62 to their respective second links 68. In that regard, each connector link 72 is joined to its respective swing arm 62 at a first junction point 74*a*, 74*b* respectively, and to its respective second link 68 at a second junction point 76*a*, 76*b*. Each connector link 72 has a handle portion 78*a*, 78*b* associated therewith. As illustrated in FIG. 6, the handle portions 78 are integral with the remainder of the connector link 72; however, the handle portions may be made to be detachable. Also, they may be movable relative to the connector link and/or they may be otherwise disposed on the connector link. Also, as in the previous embodiment, the positions of the pivot points and attachment points may be made adjustable relative to the frame and/or linkages. Also, the exercise device may employ rails, ramps or other such structures to guide the second ends of the foot links in a reciprocal path of travel.

Figure 7A:
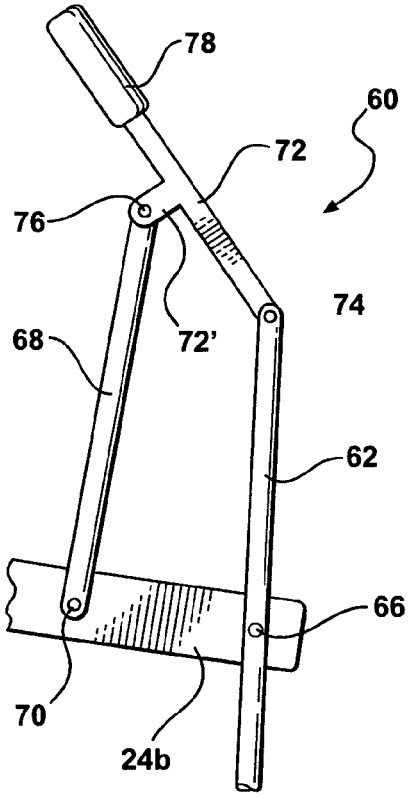
FIGS. 7A-7C depict the arm motion assembly of the FIG. 6 embodiment shown at three different positions in its operational cycle.
Figure 7B:
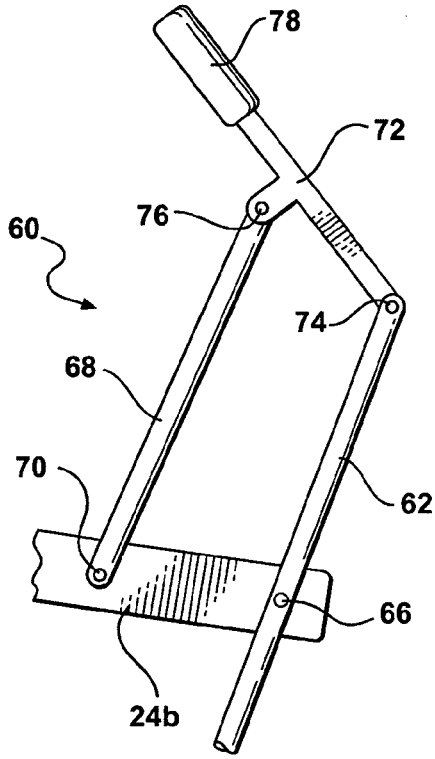
Figure 7C:
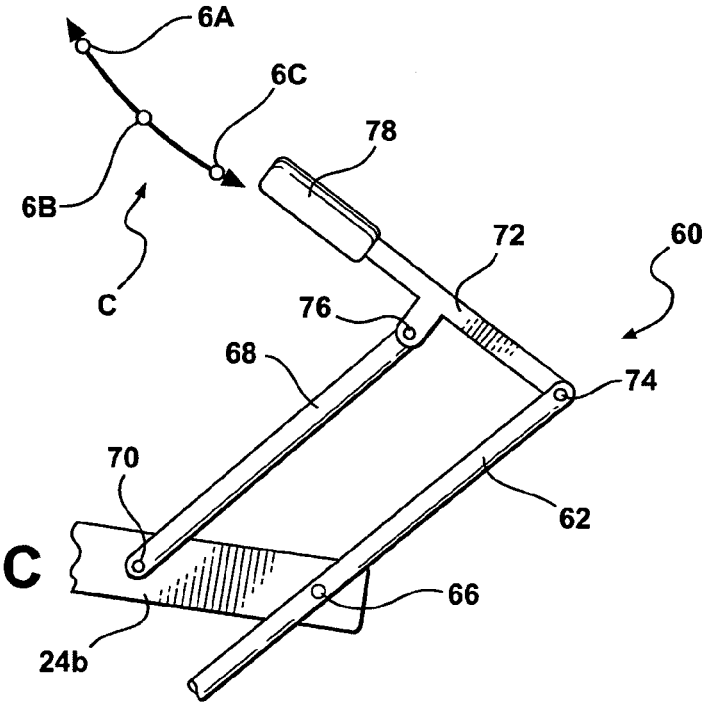

Referring now to FIGS. 7A-7C, there is shown an enlarged detail of the arm motion assembly of the FIG. 6 embodiment. For clarity of illustration, only the first link 62, second link 68 and connector link 72 of the assembly, and a portion of the frame 24*b* is shown.

As will be seen in the figures, the connector link 72 is attached to the second link 68 through a rocker arm portion 72' projecting therefrom. In other embodiments of the invention, the rocker arm 72' may be dispensed with. Also, as is illustrated, the handgrip portion 78 of the connector link 72 is shown as being linearly aligned with the main axis of the connector link. In other embodiments, the handle portion 78 may be inclined relative to the remainder of the link; and as noted above, the handle portion may be pivotable, removable or otherwise configured.

It should also be noted that in the FIGS. 7A-7C illustrations, the first link 66 is shown partly cut away insofar as the lower portion thereof is not depicted. It is to be understood that in other embodiments of the invention which do not employ swing arms, the assembly of FIGS. 7A-7C may be configured so that the first link 66 terminates shortly beyond the first pivot point 66. This will provide an arm motion assembly which is relatively compact and which may be utilized in conjunction with a variety of exercise devices such as treadmills, stair steppers and the like. In various embodiments, the assembly may be mechanically coupled to the remainder of the exercise device to produce an arm motion which is in synchrony with the exercise device. In other instances, the assembly may be mechanically coupled to the exercise device so as to operate in synchrony therewith.

Figure 1:
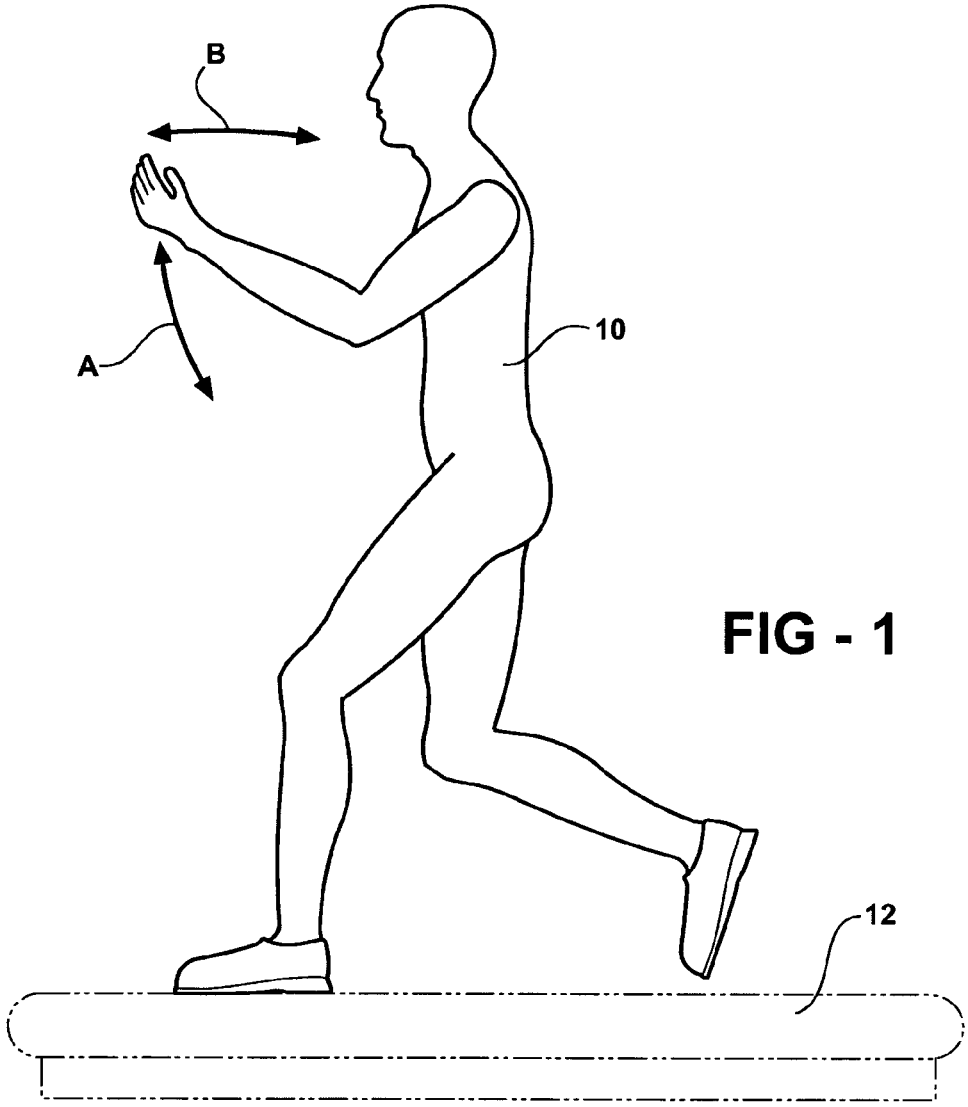
FIG. 1 is a schematic depiction showing the arm motion achieved by prior art exercise devices as compared with the arm motion achieved by the assembly of the present invention.

FIG. 7A shows the assembly of FIG. 1 in a first position. FIG. 6B shows the same assembly in a second use position wherein the two links 62, 68 have pivoted relative to the frame 64 so as to cause a corresponding movement in the connector link 72 and associated handle 78. FIG. 6C shows the same assembly 60 in a third position wherein the links 62 and 68 have pivoted to a still further degree. The arrow C in FIG. 6C shows the path of travel of the handle portion 78 as the assembly moves from the position shown in FIG. 6A to the position shown in FIG. 6C. As will be seen, the path of travel is curved in a direction which is generally angled relative to horizontal and as such provides a natural arm motion corresponding to that illustrated in FIG. 1.

While the foregoing description has been with primary regard to one specific elliptical exercise device, it is to be understood that this invention may be implemented in connection with variously configured exercise equipment which by way of illustration and not limitation includes other elliptical devices, treadmills, stair steppers, cross trainers, skiing simulators, stationary and mobile cycles, and the like.

Figure 8:
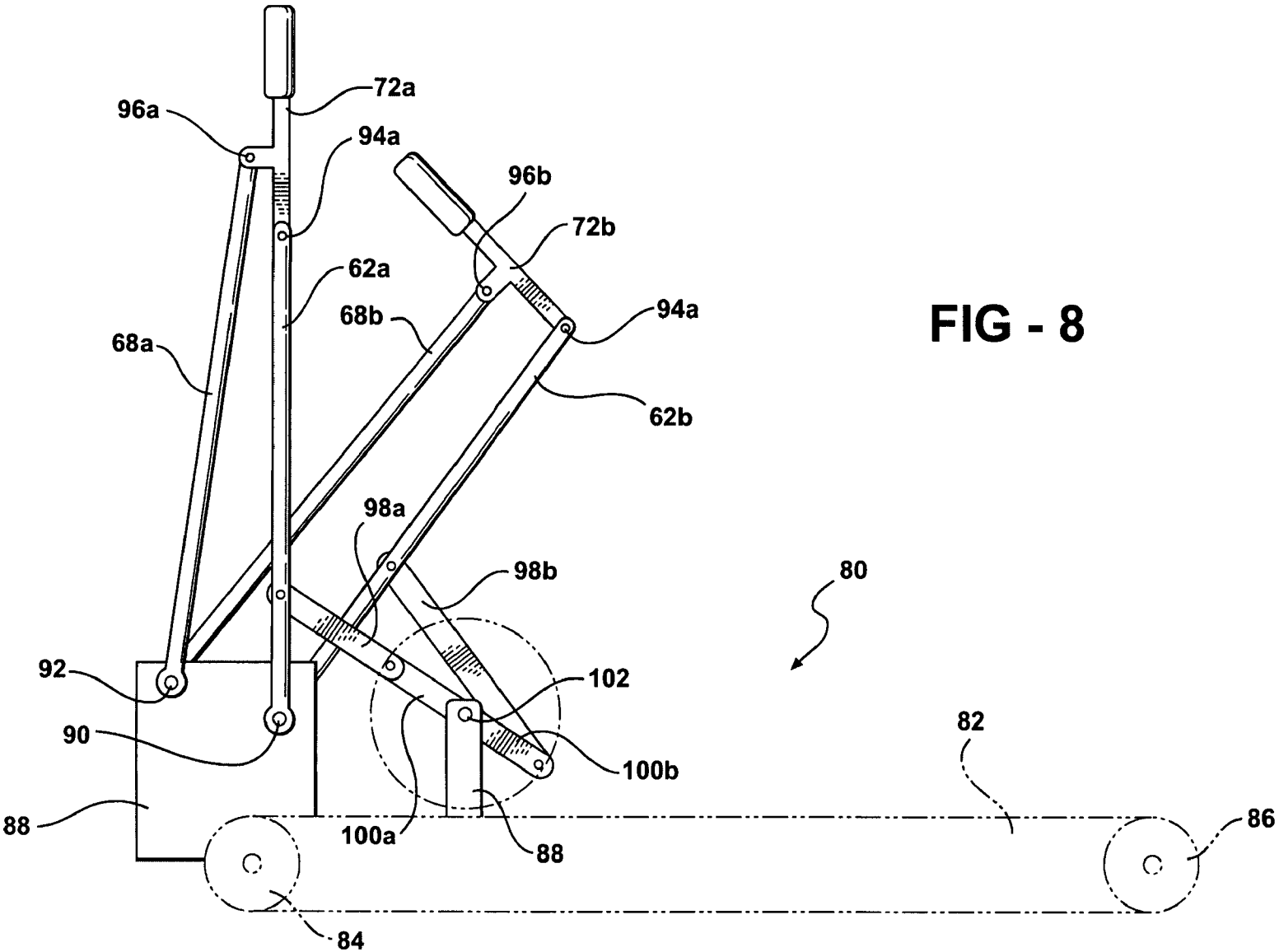
FIG. 8 depicts another embodiment of the present invention as incorporated in a treadmill.

Referring now to FIG. 8, there is shown another embodiment of an arm motion assembly as implemented in a treadmill device 80. The treadmill 80 is of conventional design insofar as it includes a belt 82 supported by a pair of rollers 84, 86. As is known in the art, the treadmill may be powered by a motor (not shown) or it may be powered solely by the user. The treadmill 80 of FIG. 8 includes an arm motion assembly generally similar to that depicted in FIGS. 6 and 7A-7C. The arm motion assembly includes a set of first links 62*a*, 62*b*; a set of second links 68*a*, 68*b*; and a set of control links 72*a*, 72*b* which are generally as described with reference to FIGS. 6 and 7A-7C. The first links 62 and the second links 68 are supported on a frame portion 88 of the device 80 at a first pivot point 90 and a second pivot point 92, respectively. As in the previous embodiment, the control links 72*a*, 72*b* are joined to their respective first and second links at first junction points 94*a*, 94*b* and second junction points 96*a*, 96*b* respectively.

In its simplest form, the assembly may merely comprise a first link, a second link and a control link affixed to the frame of the device. In such embodiments, the motion of the two sets of links is not synchronized, or otherwise joined to, the motion of the remainder of the exercise device. However, as is specifically depicted in the FIG. 8 embodiment, the arm motion assembly is configured so that the motion of the two handle portions 78*a*, 78*b* of the control links 72*a*, 72*b* is linked so that they operate in synchronization. In this regard, each of the first links 62*a*, 62*b* is coupled to a synchronization link 98*a*, 98*b*, each of which is in turn coupled to a crank arm 100*a*, 100*b* which rotates about a pivot axis 102 provided by a portion of the frame 88 of the device 80. The action of the synchronization links 98*a*, 98*b* in conjunction with the crank arms 100*a*, 100*b* assures that the handle portions 78*a*, 78*b* of the connector links 72 operate in synchronization. The crank arms 100*a*, 100*b* may be motor driven and/or coupled to the remainder of the treadmill mechanism so that actuation of the arm motion will be accomplished automatically when the belt 82 of the treadmill 80 turns.

In some embodiments, the crank arms 100*a*, 100*b* may have a flywheel associated therewith. The presence of a flywheel will smooth out the action of the arm motion assembly. Also, the arm motion assembly may have a resistance device associated therewith, so that the degree of exercise provided by the arm motion assembly can be adjusted independently of the remainder of the apparatus. As is known in the art, such resistance devices include frictional devices which employ belts, pads, calipers and the like, as well as magnetic or electromagnetic braking devices. The resistance device may be associated with the flywheel (if one is present) or with any other portion of the assembly. Use of an independent resistance device and/or a flywheel is particularly desirable when the arm motion assembly is not mechanically coupled to the remainder of the exercise device so as to move in conjunction therewith.

It will be appreciated by those of skill in the art that linkage assemblies generally similar to those described above may be likewise incorporated into other exercise devices such as stair steppers, ski devices and the like.

Figure 9:
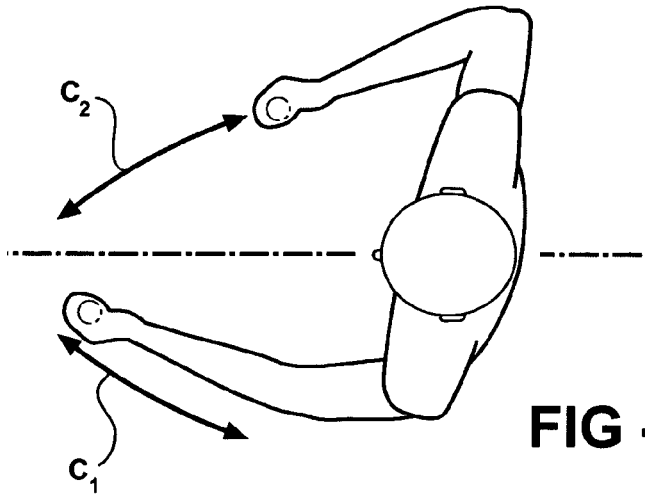
FIG. 9 is a top view of a person demonstrating a variant of the arm motion achieved through the use of the present invention.

Referring now to FIG. 9, there is shown a top plan view of a person using an exercise device of the type generally discussed hereinabove (the device is not depicted). In a natural running motion, a user's arms move in a path of travel which is curved with regard to the vertical direction as discussed hereinabove; however, this path of travel is also curved in a horizontal plane as shown in FIG. 9. Specifically, curves $C_1$ and $C_2$ are vertically curved as is shown, for example in FIG. 7C. At the same times, these paths of travel $C_1$ and $C_2$ are nonparallel and, in at least some instances, curved in a horizontal direction. The arm motion assemblies of the present invention may be configured so as to provide for such motion. For example, a simple, nonparallel but noncurved motion could be provided by angling the first and second pivot points relative to the longitudinal axis of the exercise device. Likewise, such an angled relationship can be established by employing universal joints, ball joints or the like or affixing the assembly to the frame of the exercise device. Use of universal joints, ball joints or flexible joints such as living hinges can also provide for a horizontally curved path of travel. In other embodiments, an angled and/or curved path of travel can be provided by pivotally joining the handle to its appropriate link.

It is also to be understood that while the assemblies of the present invention are depicted herein as rigid links, it is to be understood that the links may comprise flexible and/or resilient members such as springs, cables, elastomeric materials and the like taken either singly or in combination.

While specific embodiments and configurations of the assembly of the present invention have been illustrated and discussed, yet other embodiments and variations will be readily apparent to one of skill in the art in view of the teaching presented herein. The foregoing drawings, discussion and description are illustrative of specific embodiments of the invention but are not meant to be limitations upon the practice thereof. It is the following claims, including all equivalents, which define the scope of the invention.

The invention claimed is:

1. An arm motion assembly for an exercise device, said assembly comprising first and second frame portions;

a first link which is pivotally supported by said first frame portion of said exercise device at a first pivot point so that said first link is capable of reciprocal motion about said first pivot point when said exercise device is in use, said first link including a rocker arm portion which has one end pivotally attached to said second frame portion and projects therefrom in an angled relationship;

a second link which is pivotally supported by said second frame portion of said exercise device at a second pivot point spaced from said first pivot point, said second link including a handgrip; and a connector link which extends between said first link and said second link, said connector link being pivotally joined to said first link through said rocket arm at a first junction point, and to said second link at a second junction point; so that when said first link reciprocates about said first pivot point, said connector link causes said second link to pivot about said second pivot axis; whereby, said handgrip moves in a reciprocal path of travel.

2. The assembly of claim 1, wherein said first pivot point is disposed at the vertex of an angled formed by the rocker arm portion and the remainder of the first link.

3. The assembly of claim 1, wherein the location of said first junction point is adjustable relative to the first link or the connector link.

4. The assembly of claim 1, wherein the location of said second junction point is adjustable relative to the second link or the connector link.

5. The assembly of claim 1, wherein the location of the first pivot point is adjustable relative to the first link or the first frame portion.

6. The assembly of claim 1, wherein the location of the second pivot point is adjustable relative to the second link or the second frame portion.

7. The assembly of claim 1, wherein the length of the second link is adjustable.

8. The assembly of claim 1, wherein the handgrip is capable of pivoting relative to the remainder of the second link.

9. The assembly of claim 1, wherein the first link is a swing arm which is configured to be attachable to a foot link so as to direct a first end of that foot link in a reciprocal path of travel.

10. An arm motion assembly for an exercise device, said assembly comprising first and second frame portions:

a first link pivotally affixed to said first frame portion of the exercise device at a first pivot point such that said first link is capable of reciprocal motion about said first pivot point;

a second link having a first end pivotally affixed to said second frame portion of the exercise device at a second pivot point separated from said first pivot point, so that said second link is capable of reciprocal motion about said second pivot point a foot support member; said second link having a second end pivotally attached to said foot support member;

a connector link which extends between said first link and said second link, said connector link being pivotally joined to said first link at a first junction point, and to said second link at a second junction point so that when one of said first links and said second links reciprocates about its respective pivot point said connector link causes the other of said first and second links to pivot about its respective pivot point; and a handgrip which is affixed to one of: said first link, said second link, and said connector link.

* * * * *